US011523651B2

(12) United States Patent
Lebel et al.

(10) Patent No.: US 11,523,651 B2
(45) **Date of Patent: *Dec. 13, 2022**

(54) HELMET MOUNTING SYSTEM

(71) Applicant: Galvion Ltd., Portsmouth, NH (US)

(72) Inventors: Stéphane Lebel, St. Redempteur (CA); Dominic Giroux Bernier, St-Gabriel de Brandon (CA); Michael James McGinn, Montreal (CA)

(73) Assignee: Galvion Ltd., Portsmouth, NH (US)

( * ) Notice: Subject to any disclaimer, the term of this patent is extended or adjusted under 35 U.S.C. 154(b) by 106 days.

This patent is subject to a terminal disclaimer.

(21) Appl. No.: 16/700,652

(22) Filed: Dec. 2, 2019

(65) Prior Publication Data

US 2020/0178635 A1 Jun. 11, 2020

Related U.S. Application Data

(62) Division of application No. 13/563,596, filed on Jul. 31, 2012, now Pat. No. 10,492,555.

(51) Int. Cl.
*A42B 3/04* (2006.01)

(52) U.S. Cl.
CPC ..... *A42B 3/042* (2013.01); *A42B 3/04* (2013.01)

(58) Field of Classification Search
CPC ..... A42B 3/042; A42B 3/04; A42B 3/0406; A42B 3/185; A42B 3/0433; A42B 3/044; A42B 3/0446; A42B 3/0453; A42B 3/228; F41H 1/04
USPC ..... 2/422
See application file for complete search history.

(56) References Cited

U.S. PATENT DOCUMENTS

| | | | |
|---|---|---|---|
| 4,442,551 | A | 4/1984 | Hellberg |
| 4,601,070 | A | 7/1986 | Sargentini |
| 4,605,000 | A | 8/1986 | Anguita |
| 5,265,276 | A | 11/1993 | Kimberly, Jr. |
| 5,416,922 | A | 5/1995 | Horvat et al. |
| 5,623,730 | A | 4/1997 | Baudou et al. |
| 5,914,816 | A | 6/1999 | Soto et al. |
| 6,438,760 | B1 | 8/2002 | Wakefield et al. |
| 6,497,493 | B1 | 12/2002 | Theisen |
| 6,662,370 | B1 | 12/2003 | Buchanan |
| 6,691,374 | B2 | 2/2004 | Coyne |
| 6,820,285 | B2 | 11/2004 | Bataille et al. |
| 6,957,449 | B2 | 10/2005 | Prendergast |
| 7,219,370 | B1 | 5/2007 | Teetzel |
| 7,222,762 | B2 | 5/2007 | Rees et al. |
| 7,715,125 | B2 | 5/2010 | Willey |
| 7,908,667 | B2 | 3/2011 | Rogers et al. |
| 7,963,426 | B2 | 6/2011 | Gruebel et al. |
| D692,620 | S | 10/2013 | Gendron |

(Continued)

*Primary Examiner* — F Griffin Hall
(74) *Attorney, Agent, or Firm* — Wolf, Greenfield & Sacks, P.C.

(57) ABSTRACT

Systems and methods for selectively attaching an accessory mount to a helmet are disclosed. A carrier may be used to position the accessory mount on the helmet. The accessory mount may be positioned on the helmet without engaging the rim of the helmet. The carrier may be compatible with various accessory mounts to permit mounting of different accessories. The accessory mount may be a powered mount for attachment to a Night Vision Device (NVD) such as Enhanced Night Vision Goggles (ENVG), or the accessory mount may be a non-powered accessory mount.

18 Claims, 13 Drawing Sheets

(56) References Cited

U.S. PATENT DOCUMENTS

| | | | | |
|---|---|---|---|---|
| 8,661,571 | B1 | 3/2014 | Teetzel et al. | |
| 8,739,313 | B2 * | 6/2014 | Teetzel | G02B 23/125 2/6.6 |
| 9,414,633 | B2 | 8/2016 | Giroux Bernier et al. | |
| 10,492,555 | B2 | 12/2019 | Libel et al. | |
| 2007/0067894 | A1 | 3/2007 | Bourree et al. | |
| 2007/0083967 | A1 | 4/2007 | Crossman et al. | |
| 2008/0170838 | A1 | 6/2008 | Teetzel et al. | |
| 2008/0184462 | A1 | 8/2008 | Prendergast | |
| 2008/0263752 | A1 * | 10/2008 | Solinsky | A42B 3/042 2/422 |
| 2009/0038056 | A1 | 2/2009 | Bobbin et al. | |
| 2009/0077721 | A1 | 3/2009 | Prendergast | |
| 2009/0083890 | A1 | 4/2009 | Dempsey et al. | |
| 2010/0012692 | A1 | 1/2010 | Harris et al. | |
| 2010/0064405 | A1 | 3/2010 | McGovern | |
| 2010/0083413 | A1 | 4/2010 | McGovern | |
| 2010/0091377 | A1 | 4/2010 | Hedges et al. | |
| 2010/0175172 | A1 | 7/2010 | Dempsey et al. | |
| 2010/0299814 | A1 | 12/2010 | Celona et al. | |
| 2011/0072562 | A1 | 3/2011 | Prendergast | |
| 2011/0113519 | A1 * | 5/2011 | Gendron | A42B 3/326 2/2.5 |
| 2011/0113529 | A1 | 5/2011 | Milioto | |
| 2011/0145981 | A1 | 6/2011 | Teetzel et al. | |
| 2011/0170280 | A1 | 7/2011 | Soto et al. | |
| 2011/0239354 | A1 | 10/2011 | Celona et al. | |
| 2012/0011631 | A1 | 1/2012 | Crossman et al. | |
| 2012/0117717 | A1 | 5/2012 | McGinn et al. | |
| 2012/0317706 | A1 | 12/2012 | Lebel et al. | |
| 2013/0192029 | A1 | 8/2013 | Hall et al. | |
| 2013/0291290 | A1 | 11/2013 | Bernier et al. | |
| 2014/0033406 | A1 | 2/2014 | Lebel et al. | |
| 2015/0026872 | A1 | 1/2015 | Giroux Bernier et al. | |
| 2015/0135417 | A1 | 5/2015 | Lebel et al. | |
| 2015/0245682 | A1 | 9/2015 | McGinn et al. | |
| 2015/0282549 | A1 | 10/2015 | Lebel et al. | |
| 2015/0351482 | A1 | 12/2015 | Gendron et al. | |
| 2017/0027264 | A1 | 2/2017 | Giroux Bernier et al. | |
| 2017/0049176 | A1 | 2/2017 | Giroux Bernier et al. | |

* cited by examiner

HELMET MOUNTING SYSTEM

CROSS-REFERENCE TO RELATED APPLICATIONS

This application is a divisonal of and claims the benefit of U.S. patent application Ser. No. 13/563,596, filed Jul. 31, 2012, entitled "HELMET MOUNTING SYSTEM", the contents of which are incorporated herein by reference in their entirety.

FEDERALLY SPONSORED RESEARCH

This invention was made with government support under W911QY-11-C-0042 awarded by the Department of Defense. The government has certain rights in the invention.

FIELD

Aspects herein relate to mounting arrangements and methods for attaching an accessory mount to a helmet.

DISCUSSION OF RELATED ART

A soldier, first responder, or law enforcement officer, may wear protective headgear such as a helmet. Such a helmet may include an accessory, such as an illuminator, camera, video recorder, laser pointer, communications component, IFF device, or other item, to aid the helmet wearer in the performance of duties in the field. Such accessories are often removably attached to a helmet with a mount, such as a mounting plate.

SUMMARY

According to one embodiment of the invention, a helmet system includes a helmet having a rim with a downwardly-facing rim portion, an accessory mount, and a carrier that is attachable to the helmet only above the downwardly-facing rim portion. The accessory mount is removably couplable to the carrier.

According to another embodiment of the invention, a helmet system includes a helmet and a carrier for an accessory mount. The carrier has a front and a back, and the back of the carrier faces the helmet when the carrier is attached to the helmet. In addition, the carrier is constructed and arranged to removably receive and retain an accessory mount through the back of the carrier.

According to a further embodiment of the invention, a method of attaching an accessory to a helmet includes providing a first accessory mount onto which a helmet accessory can be mounted, removably coupling the first accessory mount to a carrier, and attaching the carrier to a helmet only above a downwardly-facing rim portion of the helmet.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. Various embodiments of the invention will now be described, by way of example, with reference to the accompanying drawings, in which.

DETAILED DESCRIPTION

Certain accessories for a helmet require electricity to operate. For example, a construction hardhat or a mining helmet may include a headlamp and/or a communication device. A law enforcement helmet or a combat helmet may be accessorized with various electronic devices such as a Night Vision Device (NVD), an identification friend or foe system (IFF), a helmet-mounted display unit, illumination devices, and/or other types of electronic devices. In some cases, the power is delivered to the helmet-mounted devices via a mount on the helmet. For example, a helmet may include a battery pack at the rear of the helmet and power cabling which runs along the helmet surface to a mounting plate at the front of the helmet. Electrical contacts may be included on the mounting plate such that when a device is attached to the mounting plate, the device can draw power from the battery pack via the electrical contacts of the mounting plate.

Certain mounting systems may be compatible with only a single type of device. For example, a mounting plate may be configured to mount a specific visor system model. In some cases, a mounting system may simply support the accessory device but not contribute to providing power to the accessory. In these arrangements, the accessory may include its own power supply. Accessories which receive power via the mounting system, for example via electrical contacts on a mounting plate, may require the use of a mounting plate with a specific configuration. For example, Enhanced Night Vision Goggles (ENVG) that receive power via the mounting system may necessitate a particular mounting plate configuration, and such a configuration may not be compatible with other accessories.

Figure 1:
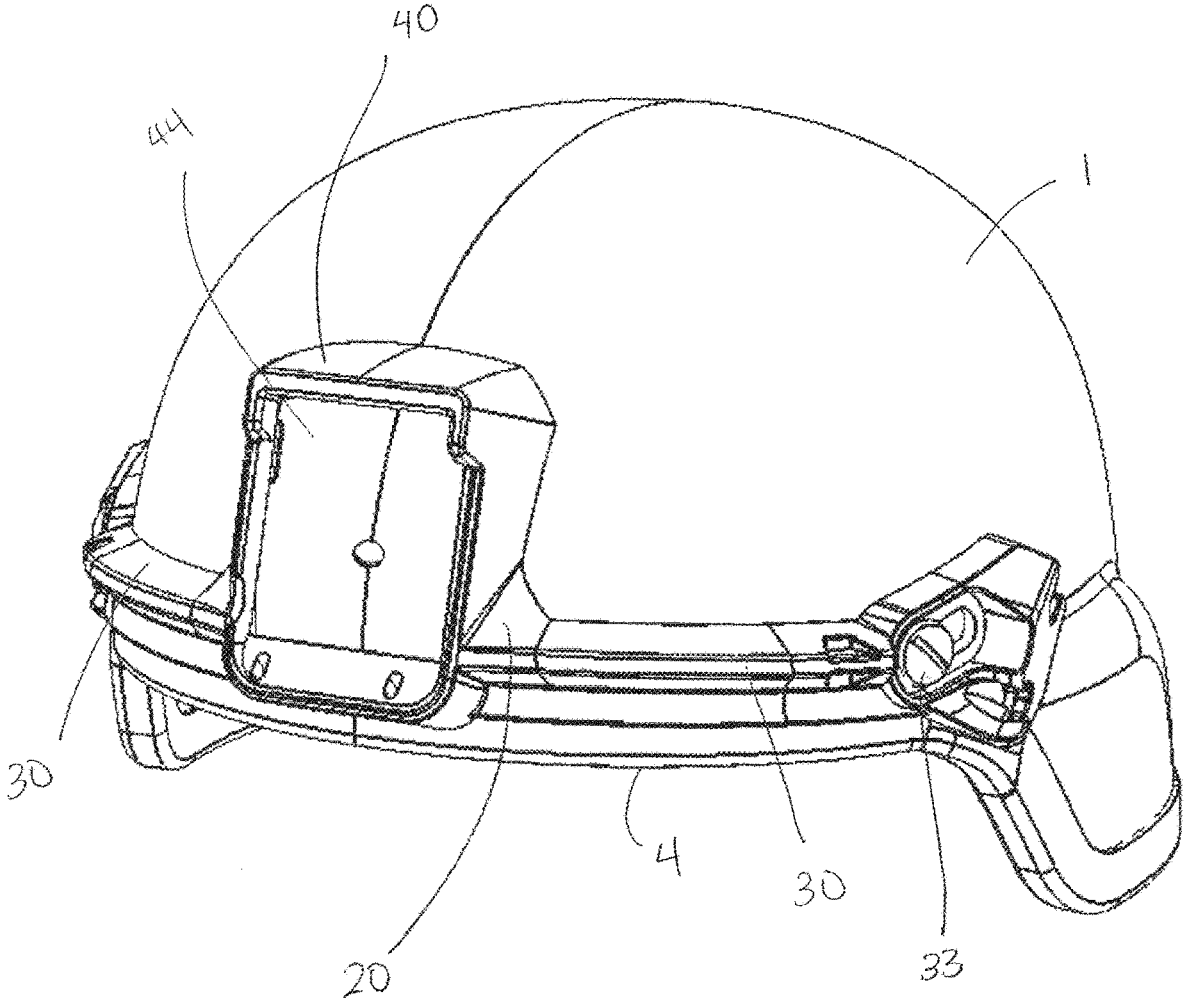
FIG. 1 is a perspective view that depicts a system for using a carrier to position an accessory mount on a helmet in accordance with an aspect of the invention.
Figure 2:
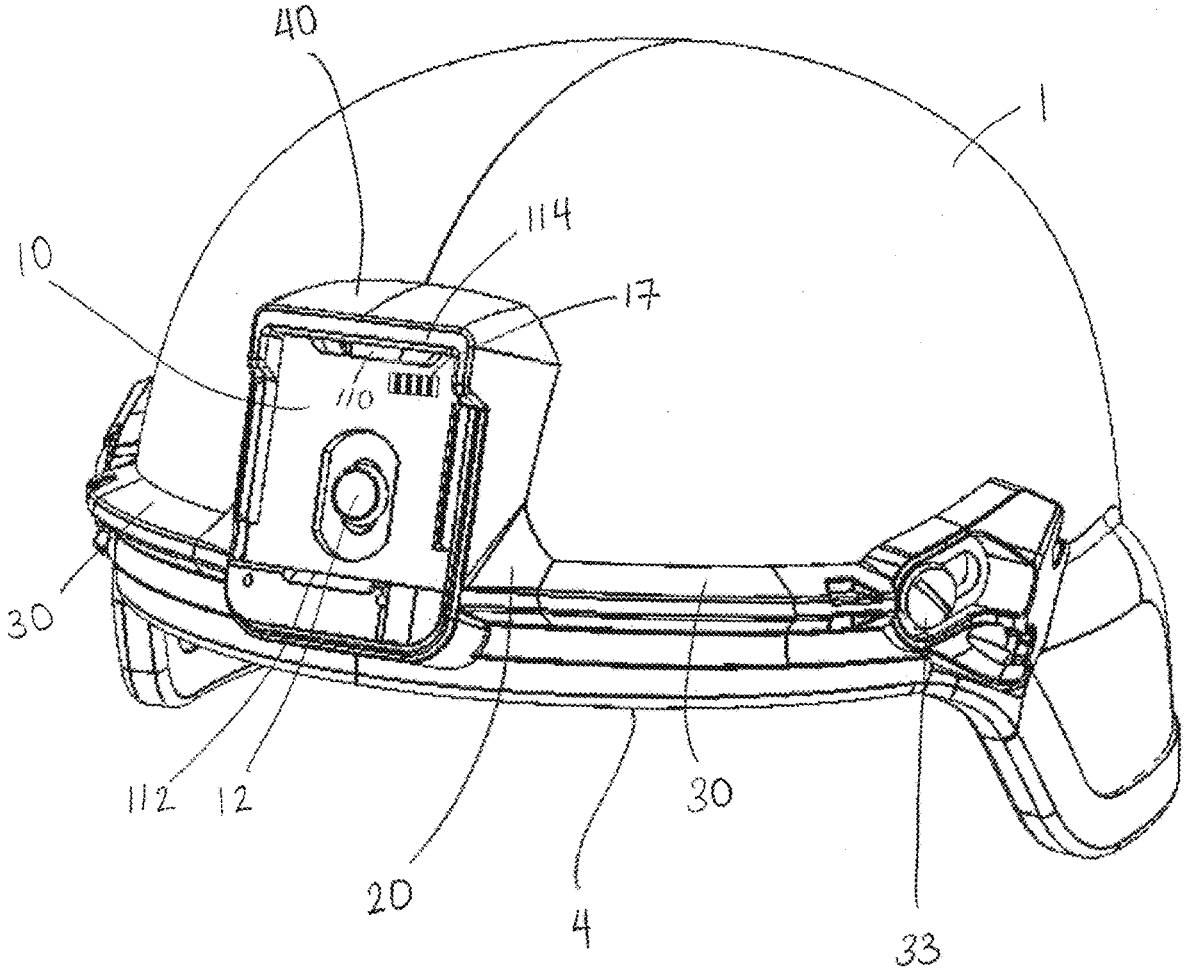
FIG. 2 is a perspective view that depicts the arrangement shown in FIG. 1 with an accessory mount coupled to the carrier.

FIGS. 1-2 illustrate one embodiment of a mounting system that includes a carrier 20 that positions an accessory mount 10 on a helmet 1. The carrier may be compatible with different types of accessory mounts, and may be arranged for the selective attachment or removal of different accessory mounts.

Embodiments disclosed herein include a mounting system which is compatible with different types of devices. For example, a mounting system may accept various different accessory mounts to allow for a wider range of devices which can be associated with a helmet. In certain embodiments, a carrier portion of a mounting system can be coupled to either of a first accessory mount and a second accessory mount, where the first and second accessory mounts are different types of accessory mounts. In some embodiments, a first accessory mount that is coupled to a carrier of a mounting system may be removed and replaced by a second accessory mount that is different from the first accessory mount.

In some embodiments, a user can selectively couple an accessory mount to the carrier. In such cases, the selection of accessory mount can be made by the end user rather than a manufacturer. For example, a user may receive a helmet and a carrier which may, or may not, be joined together. The user selects an accessory mount, couples the accessory mount to the carrier, and if applicable, attaches the carrier to the helmet. Such versatility allows a user to select an accessory mount based on various factors; for example, the weight of the accessory mount, the cost of the accessory mount, and the environment of intended use.

Further, even if a manufacturer is providing fully assembled helmets, the manufacturer does not have to commit to a specific type of accessory mount until the final stages of assembly. Thus, the manufacturer can produce a single type of mounting system that is compatible with two or more types of accessory mounts.

Additionally, where a specific type of accessory mount needs to be used on a helmet, by providing a mounting system that permits the addition of an accessory mount that is easily separable from the mounting system, an entire redesign of the mounting system is not necessarily required in order to accommodate the specific accessory mount.

Applicants have recognized that in some conventional Night Vision Device (NVD) mounting systems where an accessory mount is clamped onto the rim of the helmet, the presence of the clamp on a downwardly-facing portion of the rim can interfere with abutment and/or sealing between the helmet rim and a helmet accessory such as a face shield, a visor, or goggles. Embodiments disclosed herein include mounting arrangements in which a carrier is positioned and arranged on a helmet in a manner which permits abutment and/or sealing between the rim of the helmet and an accessory.

More specifically, according to one aspect of embodiments described herein, a mounting system includes a carrier that attaches to a helmet without clamping on the rim of the helmet or interfering with the abutment and/or sealing between the helmet rim and visor or other accessory. As shown in FIGS. 1-6B, in some embodiments, a carrier 20 includes peripheral portions such as arms 30. Arms 30 may attach the carrier 20 to helmet 1 above the downwardly-facing portion of a rim 4. In some embodiments, the carrier and peripheral portions may be removably attached to a helmet. For example, screws 33 may be threaded through the helmet 1 and arms 30 and tightened to attach the arms 30 to the helmet. When carrier 20 is attached to helmet 1, the back of carrier 20 (shown in FIGS. 6A-B) faces helmet 1. The screws 33 then may be unscrewed by hand and/or with a tool to remove the carrier 20 from the helmet 1. Any suitable attachment element or elements such as screws, bolts, adhesives, a hook-and-loop type fastener, etc. may be used to attach the peripheral portions to the helmet. As shown in FIGS. 1-6B, arms 30 may be arc-shaped and may conform to the curvature of the helmet 1. The arms may be of any suitable size, thickness, and shape. Arms 30 may also extend completely or partially around the helmet 1. Of course, it should be appreciated that the peripheral portions of the carrier may be any suitable configuration, as this aspect is not limited in this regard. For example, peripheral portions may comprise tabs or wings, and may extend from the top and/or bottom of a carrier rather than the sides.

It should also be appreciated that carrier 20 may be attached to helmet 1 in any suitable arrangement, as should be appreciated by one of skill in the art. For example, rather than attaching a peripheral portion of the carrier to a helmet, screws or other suitable fasteners may attach a central portion of the carrier to the helmet. In some cases, the carrier may attach to a helmet in a manner that does not require hardware or fasteners. For example, the carrier may slidingly engage with a helmet such that the carrier can be slid on or off of the helmet. Alternatively, a combination of both fasteners and a sliding engagement may be used to attach the carrier to a helmet. Furthermore, the carrier may be shaped in any suitable manner. Additional components or accessories such as a mandible guard, a visor, or a face shield may be attached to carrier 20 in any suitable arrangement, including embodiments disclosed in an application entitled, "Helmet Accessory Attachment System" filed on even date herewith, which is incorporated herein by reference in its entirety.

According to one aspect, the carrier positions the accessory mount on the helmet. The carrier may provide varying degrees of support to the accessory mount. The carrier may fully, partially, or minimally support the accessory mount, or, in some embodiments, the carrier may not provide any direct support to the accessory mount at all. For example, the carrier may provide sufficient support to retain a mounting plate on the carrier, but the predominant support of the mounting plate on the helmet may be provided by a screw or bolt that passes through the mounting plate and into the helmet, thereby holding the plate to the helmet.

An accessory mount can be arranged in any one of numerous configurations to mount an accessory to a helmet. In some embodiments, an accessory mount may be configured such that a single motion with an accessory, such as a sliding motion, engages a base plate of an accessory with an accessory mount. An accessory may snap into an engaged state by passing over a flexible tab or other component. In other embodiments, other mounting components may be used such as clasping devices or fasteners. As shown in FIG. 2, in some embodiments, accessory mount 10 may be a mounting plate that includes an inverted U-shaped retainer portion 114, a top slot 110 and a bottom slot 112. The mounting plate 10 may interface with a baseplate of an accessory (not shown), which may include a top tab and a bottom tab. To attach an accessory to the accessory mount 10, the top tab of the accessory baseplate engages the top slot 110 of the accessory mount 10. After the top tab of the accessory baseplate is inserted into the top slot 110 of the accessory mount 10, the baseplate is rotated downwardly such that the bottom tab engages the bottom slot 112 of the accessory mount 10. In some cases, the accessory mount may include electrical contacts that provide power to the accessory. For example, the accessory mount 10 shown in FIG. 2 includes electrical contacts 17. Of course, it should be appreciated that the accessory mount may be any suitable shape and size and may mount an accessory in any suitable manner.

In the embodiment shown in FIGS. 2-10, the carrier may be coupled to an accessory mount by fully surrounding the entire perimeter of the accessory mount. The carrier 20 may include a central portion, such as a frame 40, that surrounds the perimeter of the accessory mount 10. In some embodiments, an accessory mount may be inserted into the carrier from the back of the carrier. In some cases, the accessory mount may attach to the back of the carrier. FIGS. 6A-B depict the back of carrier 20, and FIGS. 7A-D depict the back of a central portion of carrier 20. As shown in FIGS. 2-6B, frame 40 includes an open space 44 that receives accessory mount 10. Accessory mount 10 may be inserted into the open space 44 from the back of the frame 40 and may be attached to the frame 40 at the back of carrier 20. When carrier 20 is attached to helmet 1, carrier 20 serves to fully support accessory mount 10 on the helmet. In some cases, accessory mount 10 may be directly secured to the helmet by a bolt 12 that is threaded through the accessory mount 10 and into or through the helmet 1, or by any suitable fastener.

Figure 7A:
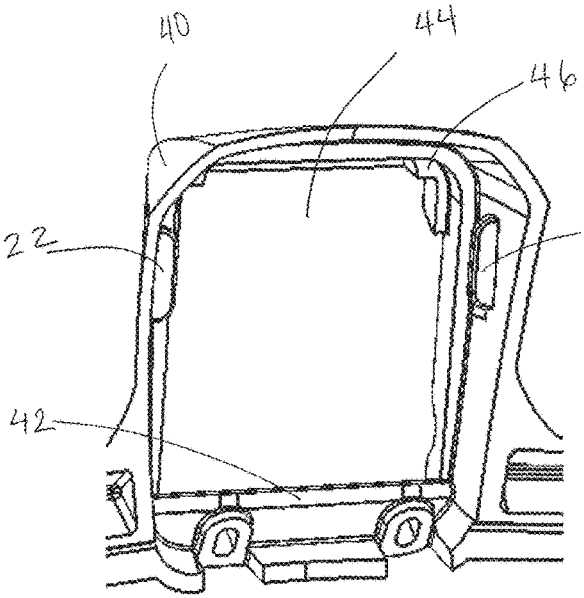
FIG. 7A is a perspective view of the back of the carrier depicted in FIG. 1.
Figure 7B:
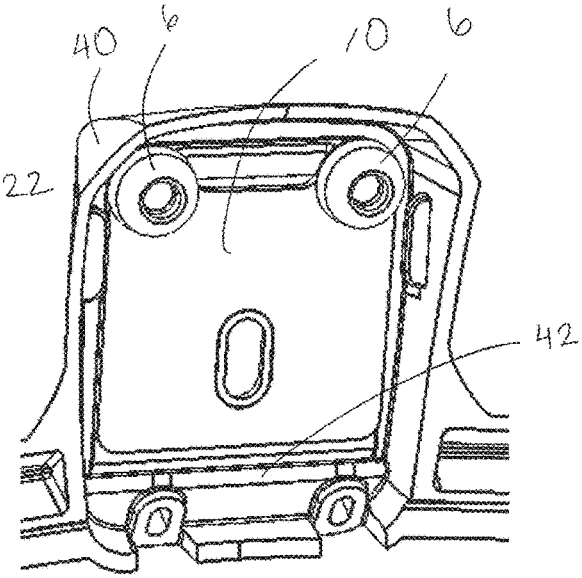
FIG. 7B is a perspective view that depicts the back of the carrier shown in FIG. 7A coupled to an accessory mount.

According to one embodiment depicted in FIGS. 7A-11, accessory mount 10 may be coupled to frame 40 of carrier 20. FIG. 7A depicts the back of carrier 20 and a mount-receiving frame 40 which includes an open space 44. The bottom portion of frame 40 may include a ledge 42 that extends slightly into space 44. In some embodiments, ledge 42 may be arranged to slant partially toward the back of frame 40 (slanting out of the page in FIG. 7A). The top portion of frame 40 may include a lip 46 that also extends slightly into space 44. Lip 46 may extend along the entire border of space 44 or may partially extend along the border of space 44. Lip 46 may also include multiple partial lips. The sides of frame 40 may include tabs 22 that extend partially into space 44.

Figure 5A:
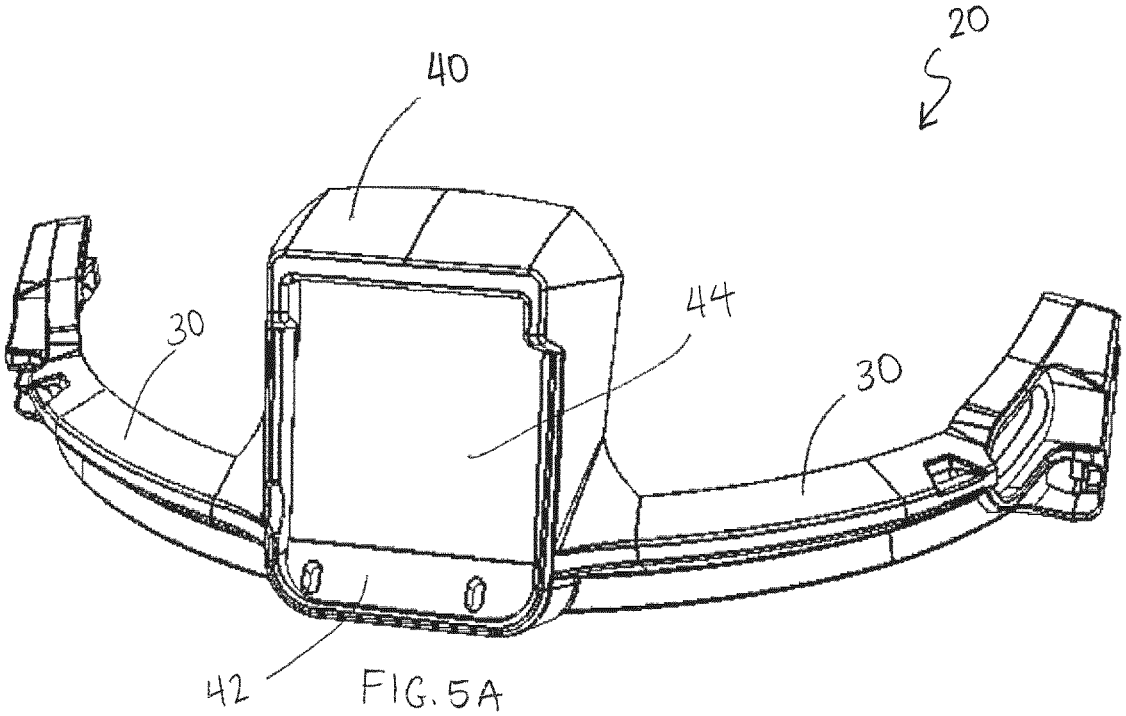
FIG. 5A is a perspective view that depicts an enlarged view of the carrier shown in FIG. 1.
Figure 5B:
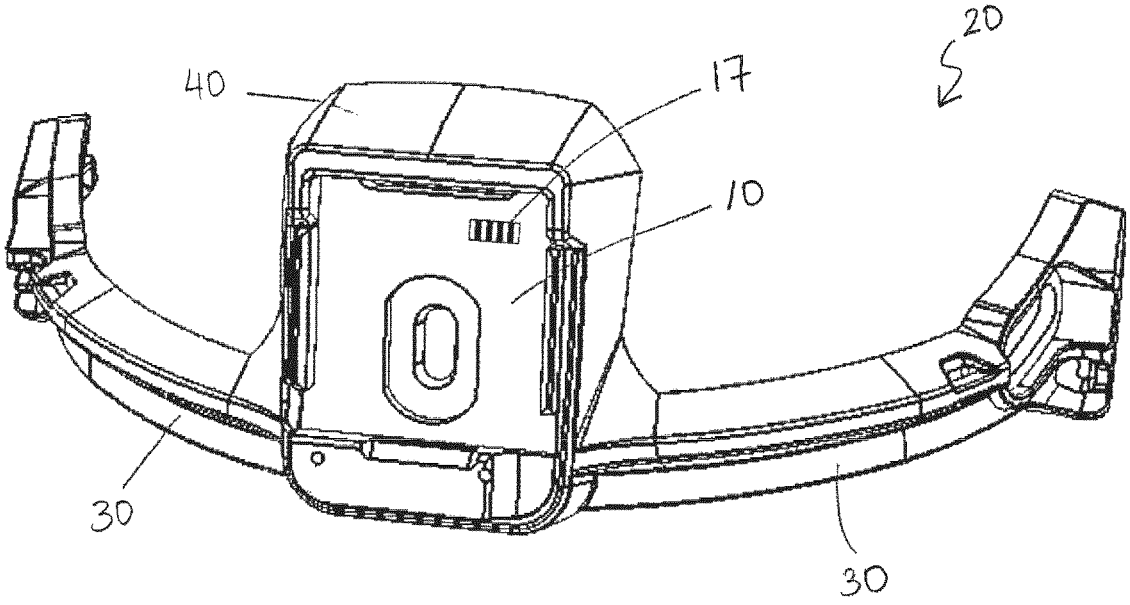
FIG. 5B is a perspective view that depicts the carrier shown in FIG. 5A with an accessory mount coupled to the carrier.
Figure 6A:
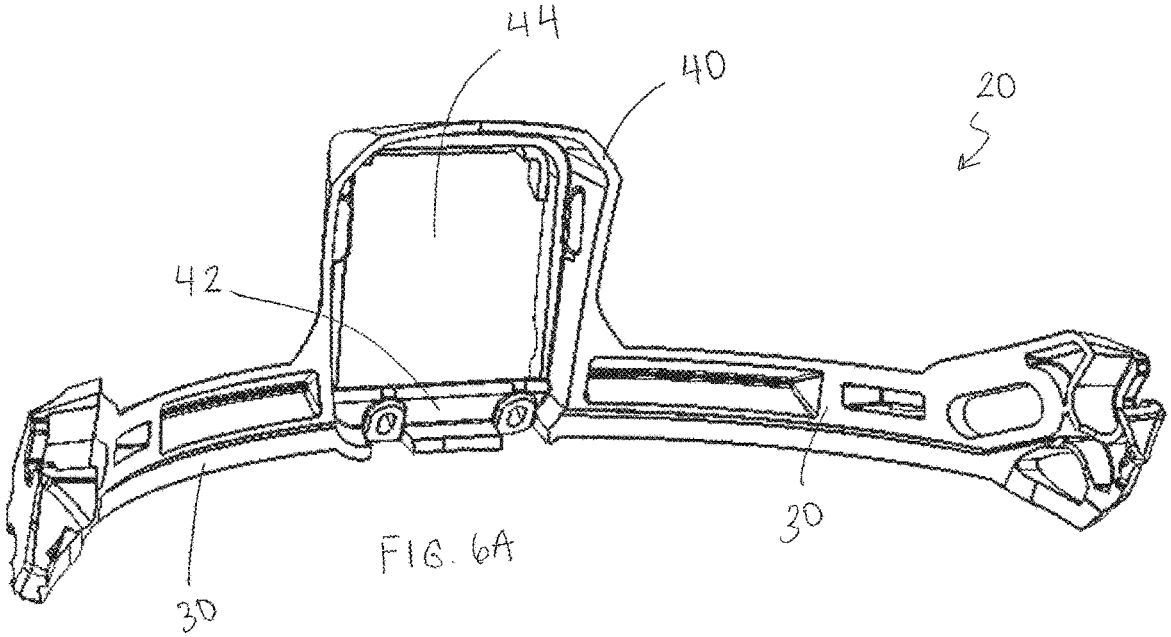
FIG. 6A is a perspective view of the back of the carrier shown in FIG. 5A.
Figure 6B:
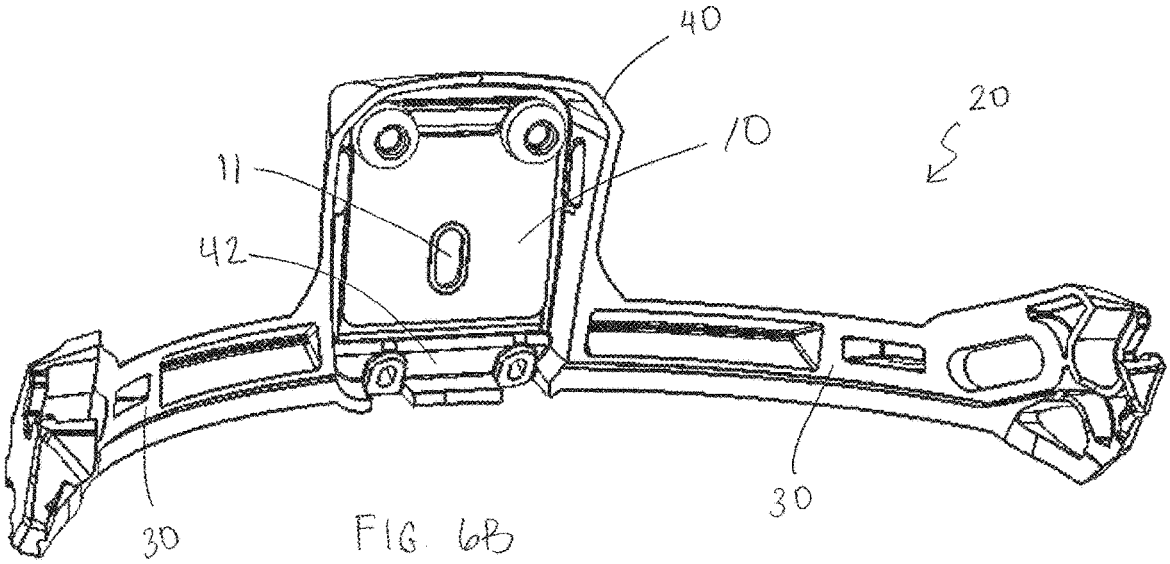
FIG. 6B is a perspective view of the back of the carrier coupled to the accessory mount shown in FIG. 5B.
Figure 7C:
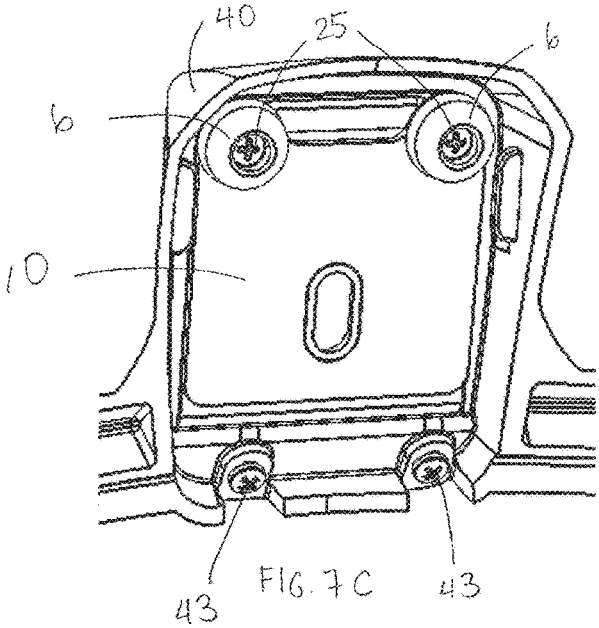
FIG. 7C is a perspective view that depicts screws attaching the back of the carrier shown in FIG. 7B to the accessory mount.
Figure 7D:
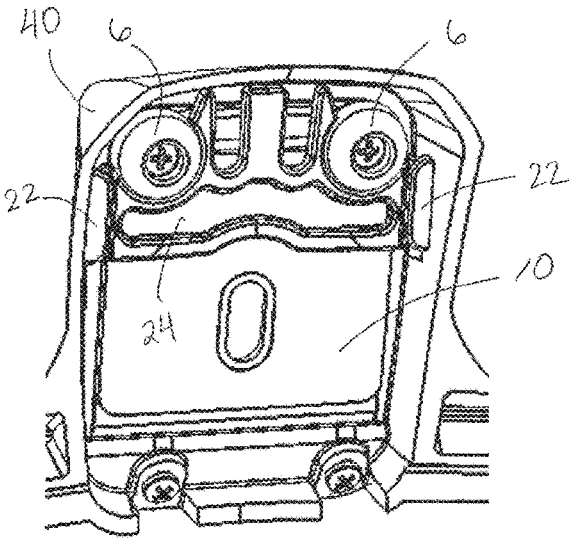
FIG. 7D is a perspective view that depicts a shim further attaching the back of the carrier shown in FIG. 7C to the accessory mount.

The accessory mount 10 is inserted into carrier 20 from the back of the carrier 20 by inserting the accessory mount 10 into frame 40. To insert an accessory mount 10 into frame 40, the bottom of accessory mount 10 is first inserted into space 44 from the back of frame 40. With reference to the perspective back view shown in FIGS. 7A-B, the bottom of accessory mount 10 is slid behind ledge 42 and the top of accessory mount 10 is rotated into space 44 until the top of accessory mount 10 contacts the lip 46. From a perspective front view, as shown in FIG. 5B, accessory mount 10 is positioned in front of ledge 42 such that ledge 42 cannot be seen from the front. As shown in FIG. 7C, accessory mount 10 may be attached to the back of frame 40 and carrier 20 via screws 43 that are threaded through the accessory mount 10 and through the ledge 42, which is attached to frame 40. In addition, rubber bumpers 6 may be attached to the top portion of accessory mount 10 via screws 25 that extend through the accessory mount 10 and through bumpers 6. When the back of frame 40 is mounted to the helmet 1 via attachment of the carrier 20 to the helmet 1, bumpers 6 rest against the helmet 1 and help to position and cushion the carrier 20 on the surface of the helmet 1. Any suitable fastener may be used to attach accessory mount 10 to frame 40 and bumpers 6, as this aspect is not limited in this regard. Finally, as shown in FIG. 7D, a shim 24 may be slid between accessory mount 10 and tabs 22 and snapped in place onto rubber bumpers 6 to further secure accessory mount 10 to frame 40.

Of course, it should be appreciated that the accessory mount may be coupled to the carrier in any suitable manner. For example, the accessory mount may be coupled to the front of the carrier. The carrier may include a frame which receives the accessory through the front of the carrier in a manner similar to the embodiments described herein that receive the accessory mount at the back of carrier. In arrangements where the accessory mount can be received at the front, the carrier may be arranged for attachment and removal of accessory mounts without removal of the carrier from the helmet. Alternatively or additionally, the accessory mount may be attached to the front of the carrier via fasteners and/or a sliding engagement.

Figure 8:
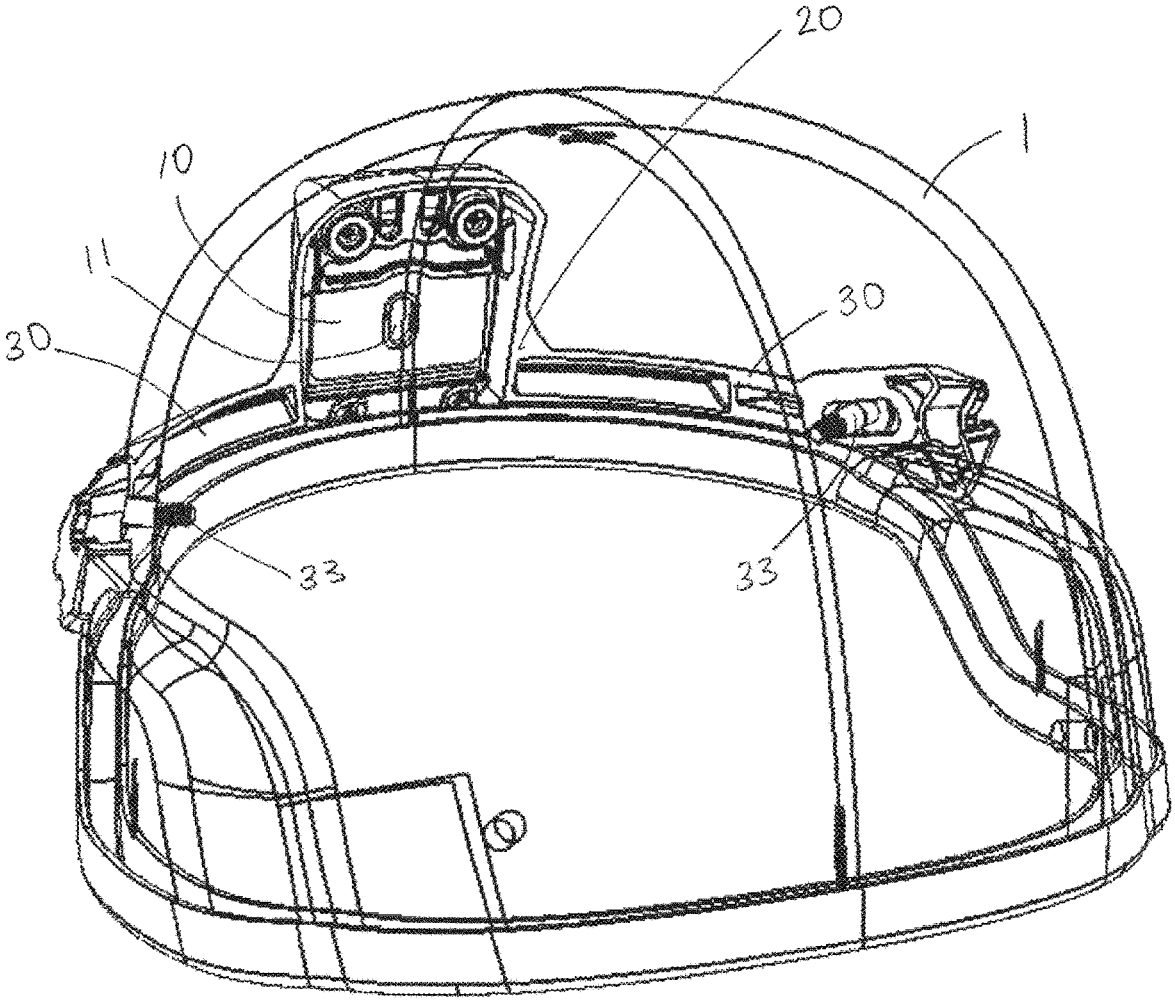
FIG. 8 is a perspective view that depicts the back of the carrier shown in FIG. 7D attached to a helmet, the helmet being shown in phantom.
Figure 9A:
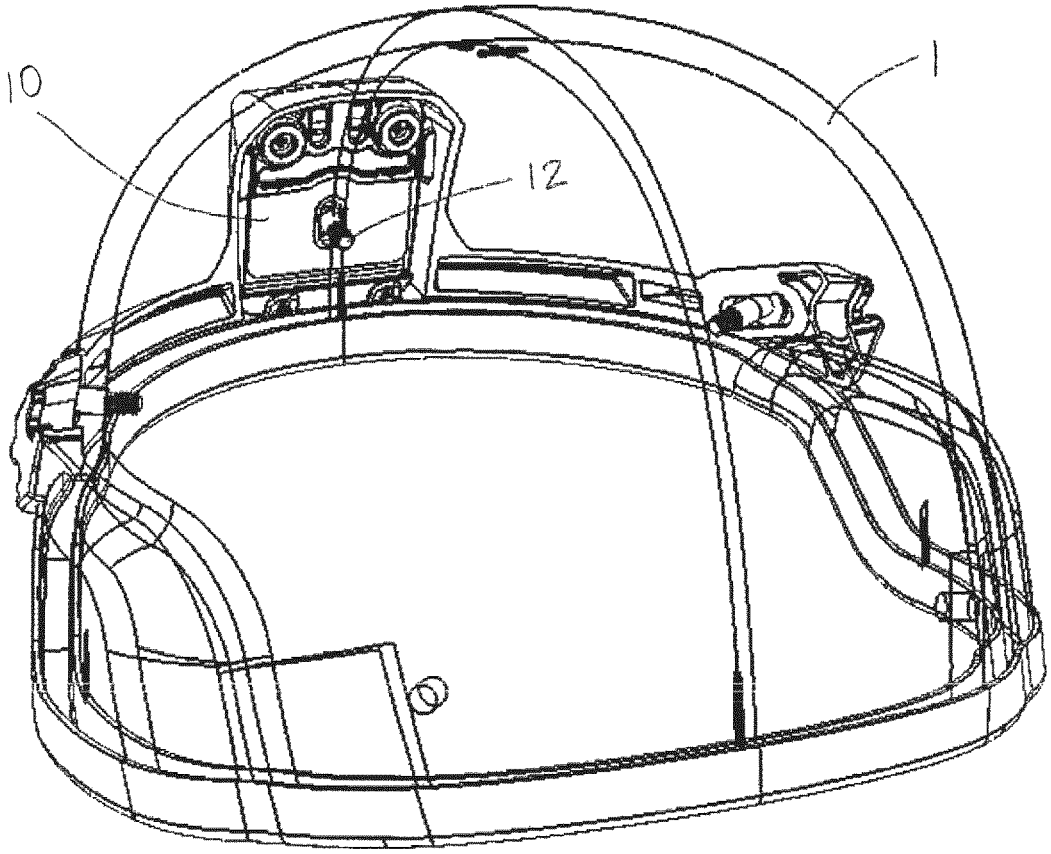
FIG. 9A is a perspective view that depicts the back of the carrier and helmet shown in FIG. 8 with a bolt attaching the accessory mount to the helmet, the helmet being shown in phantom.
Figure 9B:
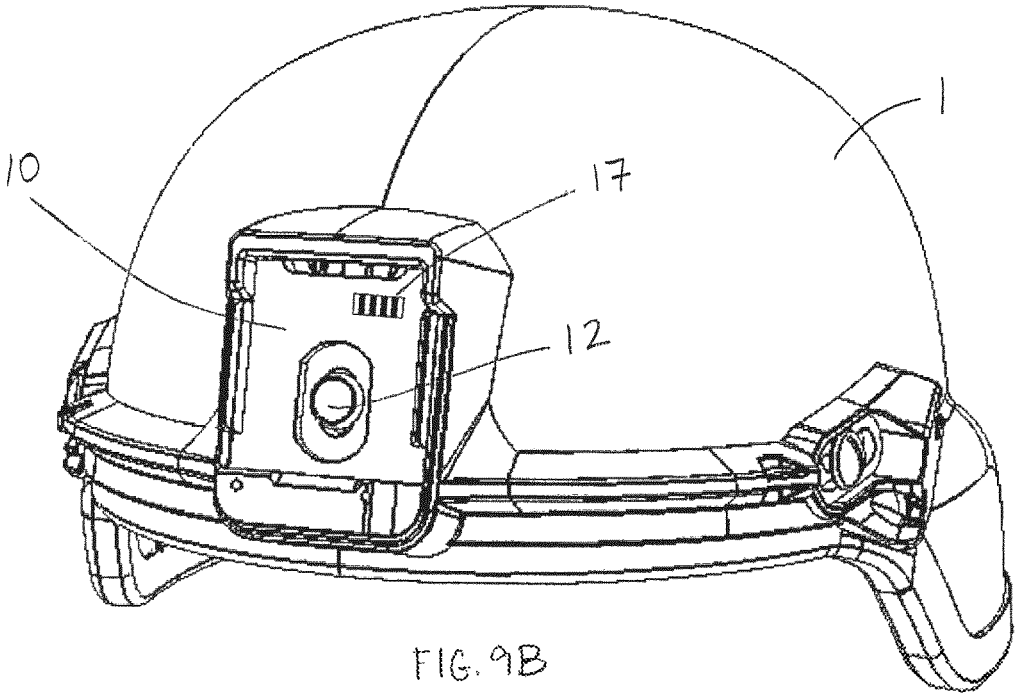
FIG. 9B is a perspective view of the front of the helmet shown in FIG. 9A.
Figure 10:
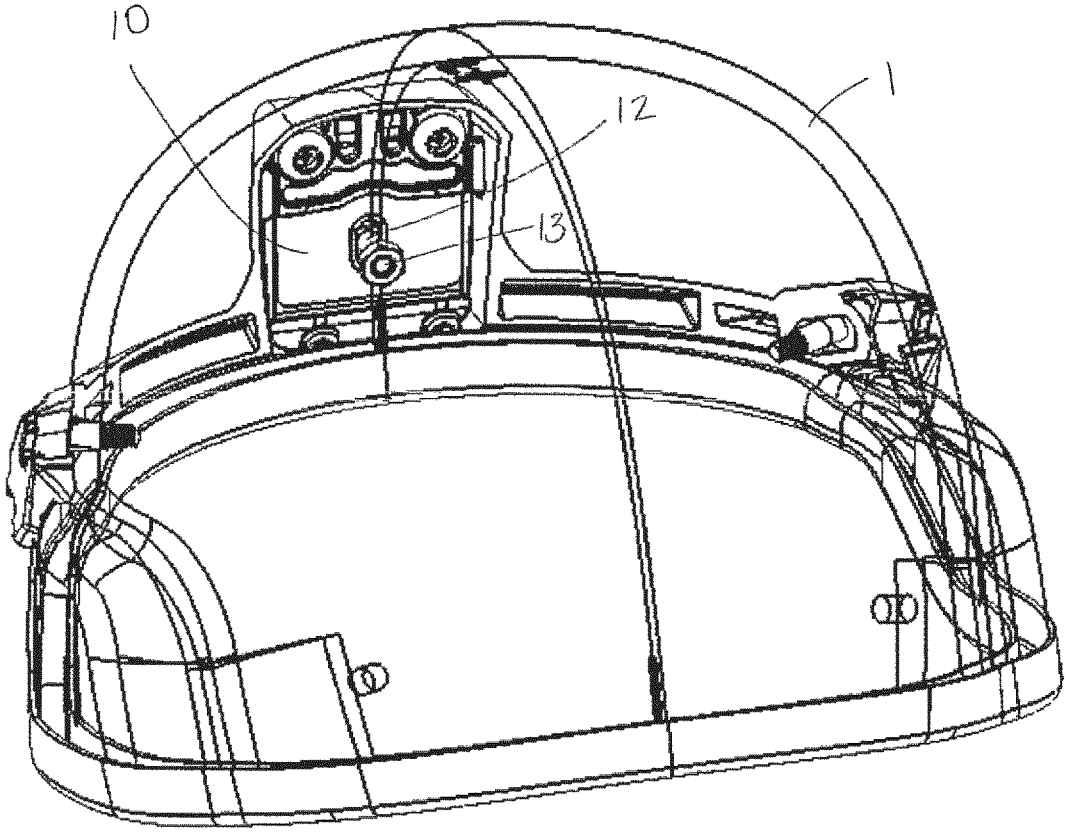
FIG. 10 is a perspective view that depicts the back of the helmet, accessory mount and bolt shown in FIG. 8 with a nut securing the accessory mount to the helmet by attachment to the bolt, the helmet being shown in phantom.

As shown in FIG. 8, carrier 20 is then attached to helmet 1 (shown as transparent) via screws 33 that are threaded through the helmet 1 and arms 30 of carrier 20. As shown in FIGS. 9A-9B, a bolt 12 is threaded through opening 11 (see FIG. 8) of accessory mount 10 and through helmet 1. Finally, as shown in FIG. 10, a nut 13 is attached to the end of bolt 12 on the inside of helmet 1 to secure the accessory mount 10 to the helmet 1. It should be appreciated that the carrier may be coupled to and fully support the accessory mount without the use of fasteners. For example, the accessory mount may be coupled to the carrier via an interference or friction fit, or the accessory mount may slidingly engage with the carrier, or other methods of attachment may be used. Of course, other configurations for the carrier are possible, as this aspect is not limited in this regard. In some cases, an accessory mount may be coupled to the carrier without the carrier fully supporting the accessory mount. In some embodiments, the accessory mount may be coupled to the carrier where the carrier partially supports the accessory mount. For example, the carrier may only partially surround the accessory mount. The carrier may have a central portion that only contacts the sides and bottom of an accessory mount. In some cases, the carrier may have a central portion that only contacts the bottom of an accessory mount. In some embodiments, the accessory mount may be coupled to the carrier where the carrier minimally supports the accessory mount. For example, an accessory mount may be directly attached to the helmet, while the carrier may have a central portion that comprises two vertical tabs positioned on either side of the accessory mount that prevent the accessory mount from rotating and/or moving side to side. Alternatively or in addition, the carrier may be constructed and arranged to prevent the accessory mount from tilting forward. In some embodiments, the accessory mount may be coupled to the carrier while the carrier does not support the accessory mount at all.

According to one aspect of the invention, the mounting arrangement may permit an accessory mount to be removably attached to the helmet. In the embodiment shown in FIGS. 7A-11, after accessory mount 10 is mounted to helmet 1, screws 33, 43, 25 and bolt 12 can all be loosened and removed to detach accessory mount 10 from helmet 1, thereby permitting accessory mount 10 to be removably attached to helmet 1.

Figure 11A:
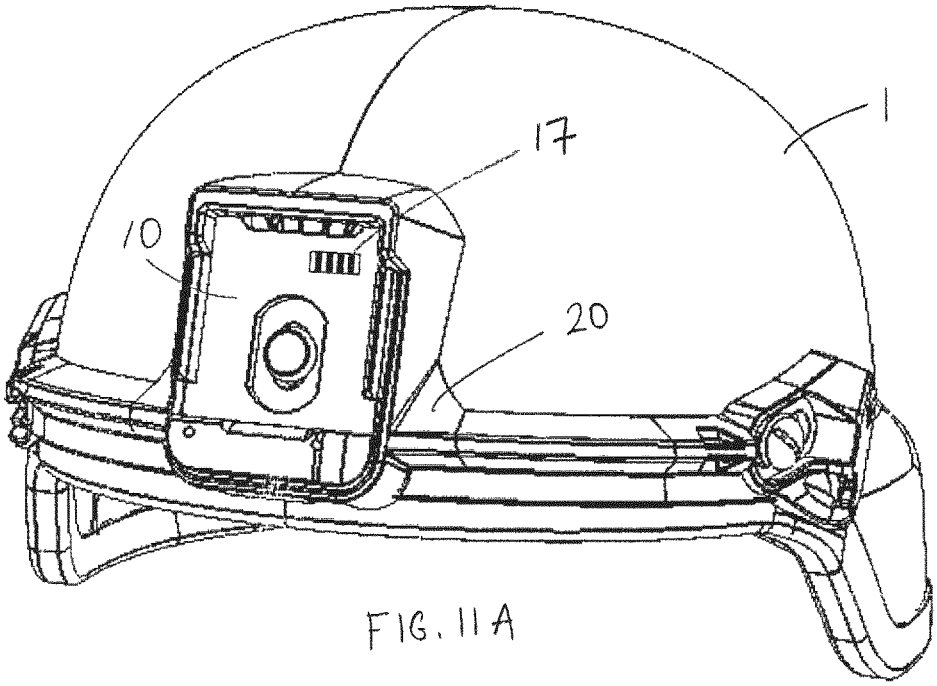
FIG. 11A is a perspective view that depicts a first accessory mount positioned on a helmet.
Figure 11B:
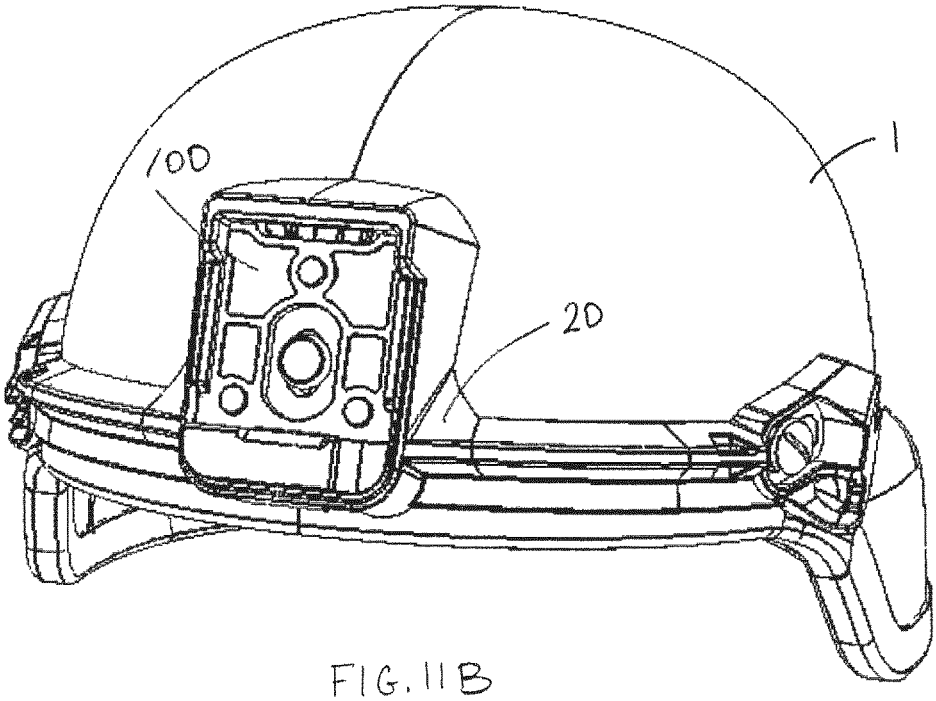
FIG. 11B is a perspective view that depicts the helmet shown in FIG. 11A, where the first accessory mount is replaced by a different second accessory mount.

According to another aspect of the invention, the accessory mount that is coupled to the carrier may be interchanged with different objects or accessory mounts. For example, in FIG. 11A, the accessory mount 10 discussed in earlier embodiments is coupled to carrier 20. In FIG. 11B, accessory mount 10 is removed and replaced with a different accessory mount 100. Carrier 20 is compatible with both accessory mounts 10 and 100, which are different types of accessory mounts. For example, accessory mount 10 may be a mounting plate that attaches to the baseplate of an Enhanced Night Vision Goggle (ENVG) while accessory mount 100 may be a mounting plate that attaches to the baseplate of a Night Vision Goggle (NVG). Carrier 20 may be compatible with powered accessory mounts as well as non-powered accessory mounts. Devices that require external power, such as some types of ENVGs, may be mounted to a powered accessory mount that supplies power from a battery pack or other energy source to the device. As shown in FIG. 11A, accessory mount 10 includes electrical contacts 17 that provide power to the ENVG. Devices that do not require power, or have their own power supplies provided as part of the device unit, such as some types of NVGs, may be mounted to a non-powered accessory mount. As shown in FIG. 11B, accessory mount 100 does not include electrical contacts. In some cases, non-powered accessory mounts may be lighter and thinner than powered accessory mounts. Accordingly, using a non-powered accessory mount when an external energy source is not needed may decrease some of the weight applied to a wearer's head.

Figure 12:
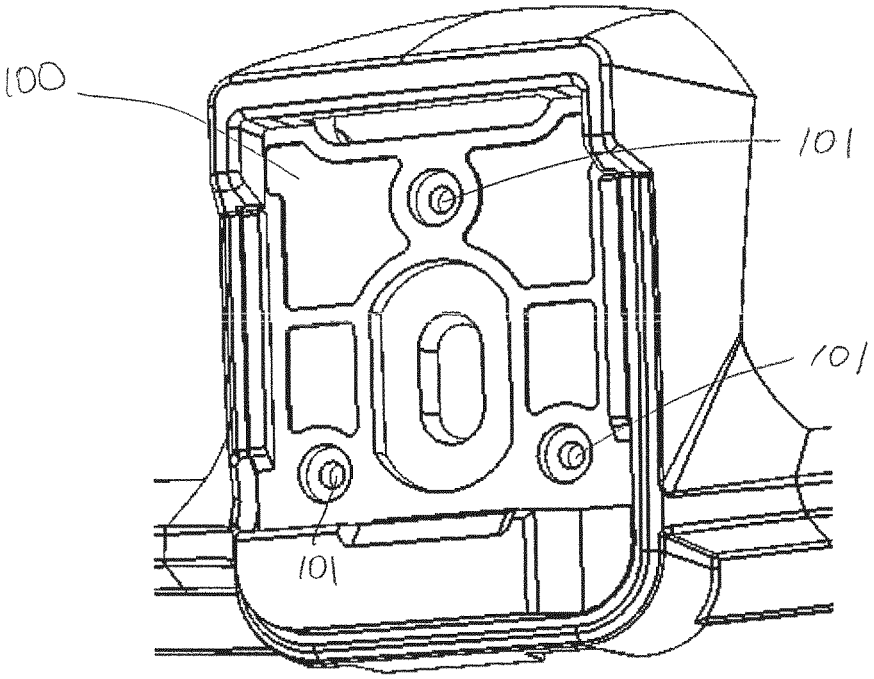
FIG. 12 is a perspective view that depicts the carrier and second accessory mount shown in FIG. 11B.
Figure 13A:
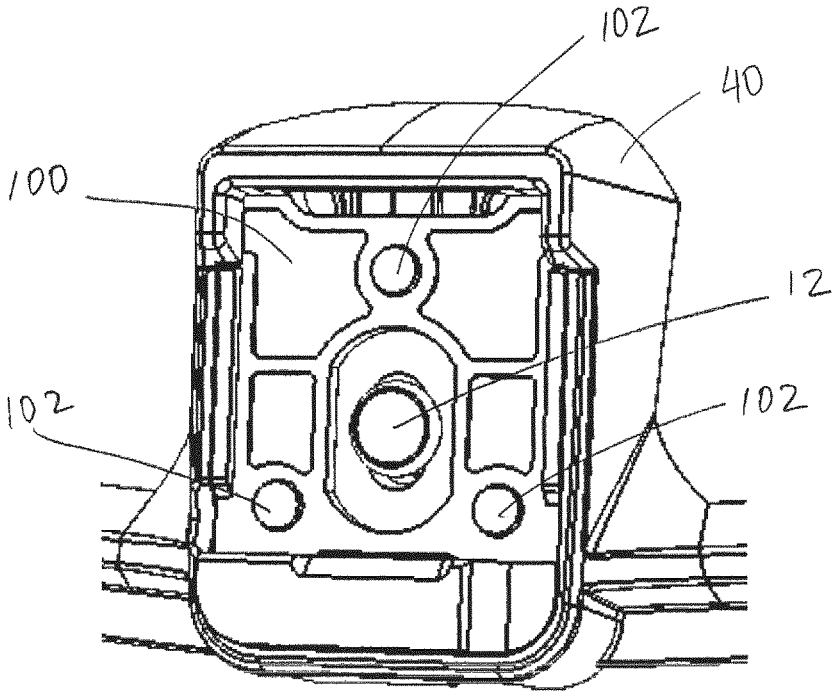
FIG. 13A is a perspective view that depicts the carrier and second accessory mount shown in FIG. 11B with a bolt and rubber stops.
Figure 13B:
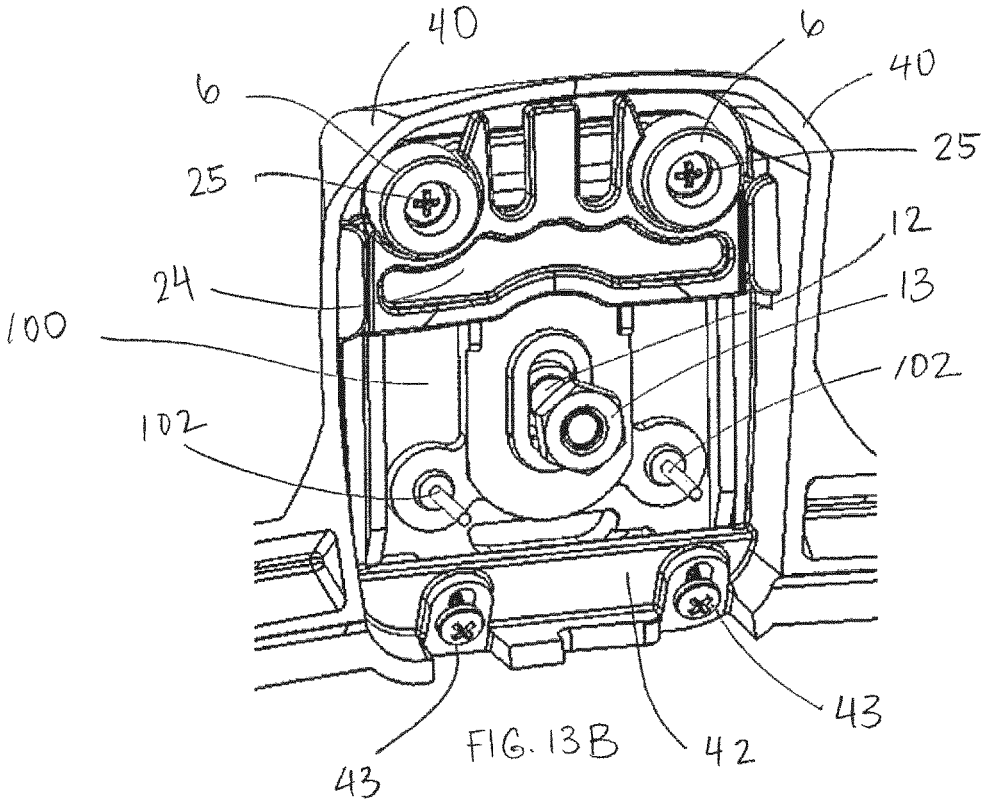
FIG. 13B is a perspective view that depicts the back of the carrier and second accessory mount shown in FIG. 13A.

As shown in FIGS. 12-13B, the accessory mount 100 for the NVG may include several holes 101 that receive rubber bumpers 102. Rubber bumpers 102 allow for a secure fit between the NVG and the accessory mount 100 and act as a damper by decreasing noise or vibration between the NVG and the accessory mount 100 when the helmet is in motion. As shown in FIG. 13B, accessory mount 100 may be attached to frame 40 of carrier 20 in a manner similar to the embodiments discussed above. Accessory mount 100 may be coupled to frame 40 via screws 43, bumpers 6, and shim 24 in the manner discussed in previous embodiments. Accessory mount 100 may also be attached to helmet 1 via bolt 12 and nut 13 in the manner discussed in previous embodiments.

Figure 3:
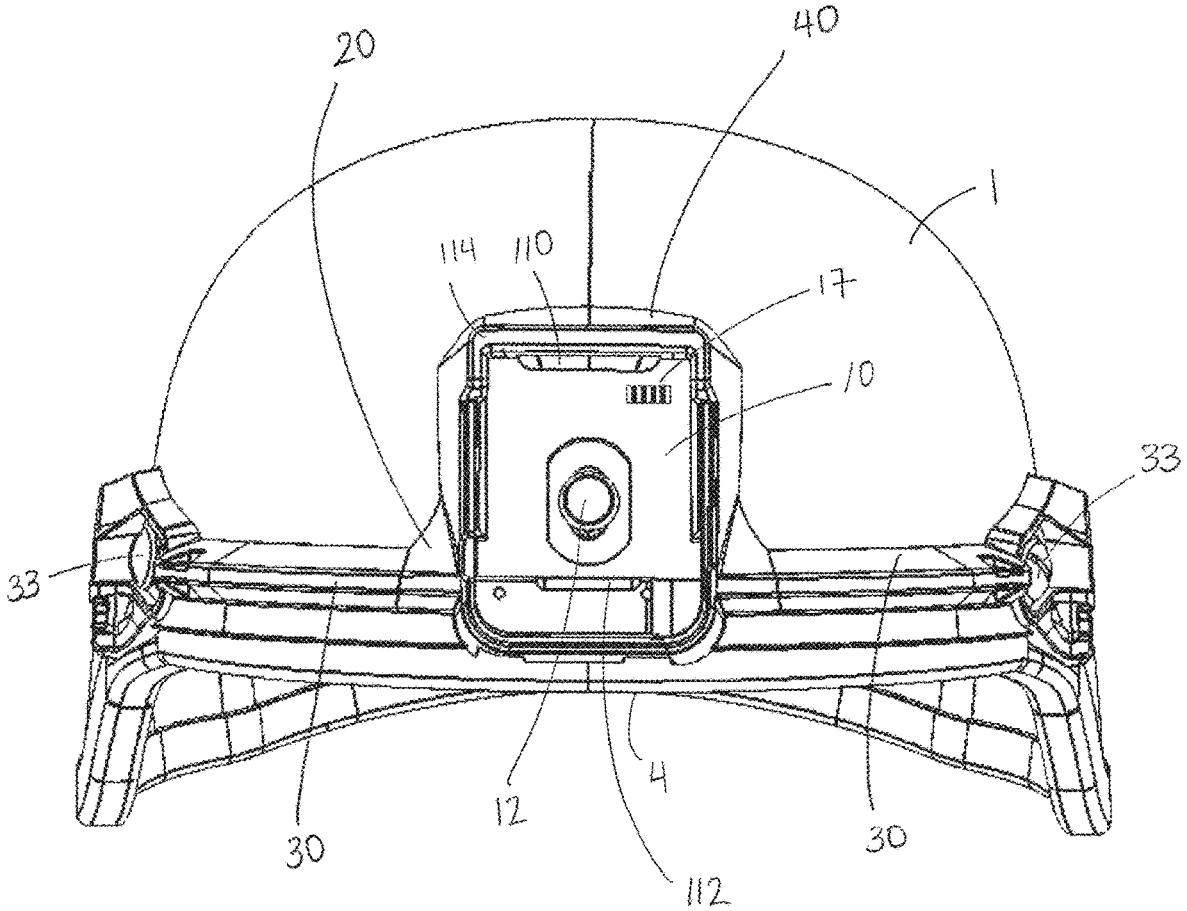
FIG. 3 is a front view of the arrangement shown in FIG. 2.
Figure 4:
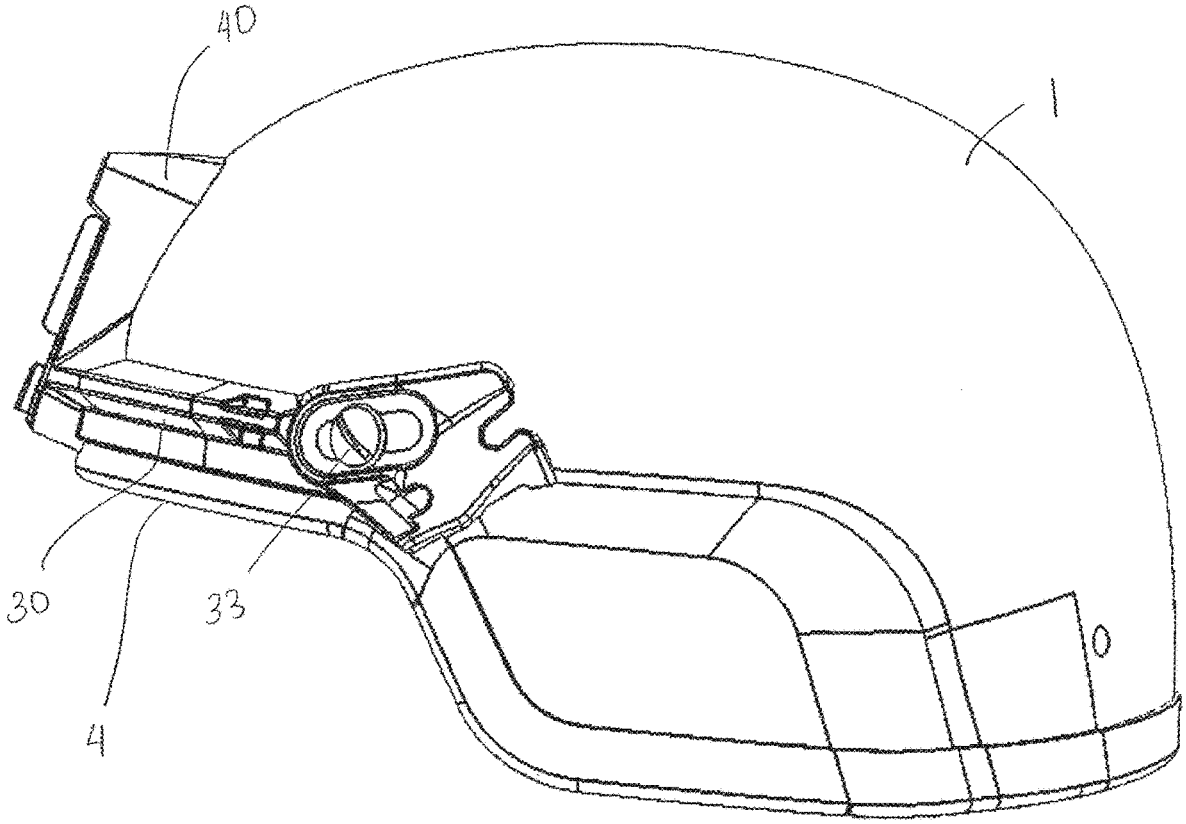
FIG. 4 is a side view of the arrangement shown in FIG. 2.

According to one aspect of embodiments disclosed herein, the carrier may attach to the helmet in a manner that leaves the rim of the helmet free to abut or seal against any suitable accessory such as a visor or face shield. As shown in FIGS. 1-3, helmet 1 includes a rim 4. As shown in FIGS. 1-4, carrier 20 attaches to the helmet without attaching to rim 4. Carrier 20 is positioned above the downwardly-facing portion of rim 4 of the helmet 1, thereby permitting face and/or eye protecting accessories such as a visor, face shield or goggles to freely abut against the rim 4. In some embodiments, an accessory may include a gasket to seal against the rim 4 of the helmet 1. In some cases, a seal between a helmet and an accessory may prevent ingress of fluids. Arranging the carrier 20 above the rim 4 keeps the space below the rim free of obstructions from the carrier 20, thereby permitting the rim 4 of the helmet to form a seal against any suitable accessory.

The above described components may be made of various materials, as the invention is not necessarily limited to particular compositions. For example, the helmet and carrier may be made of various polymers, composites, metals and combinations of any of the foregoing. In one embodiment, the carrier and/or helmet may be made from an ultra-high molecular weight polyethylene known as Dyneema®, which may be obtained from DSM Dyneema LLC. In one embodiment, the carrier and/or helmet may be made from a synthetic fiber such as Kevlar®, which may be obtained from DuPont. In one embodiment, the carrier and/or helmet may be made from carbon fibers. The carrier and the helmet may be made from materials designed to withstand various ballistic, compression and deformation testing, such that the battery and helmet are suitable for various military applications. In one embodiment, the carrier may be made of a nylon material. The mounting hardware between the carrier, helmet, and accessory mount may be constructed of any suitable material such as a metal, polymer, composite, or combination of any of the foregoing.

According to one aspect, the mounting hardware may be formed using any suitable process. The hardware may be stamped out of sheet metal, cast, injection molded, extruded, and so on. In addition, the carrier may be formed using any suitable process, such as injection molding, extrusion, casting, blow-molded, and so on. Any suitable finishing and/or processes may be applied to the hardware and/or carrier.

The above aspects may be employed in any suitable combination, as the present invention is not limited in this respect. Additionally, any or all of the above aspects may be employed in a helmet mounting system; however, the present invention is not limited in this respect, as the above aspects may be employed with other mounting applications.

According to some embodiments, accessories are attached to a helmet using any of the mounting systems disclosed herein. Such arrangements and methodologies of use are not limited solely to helmet applications. According to some aspects, the mounting system may be used to mount accessories to body armor and other articles.

Having thus described several aspects of at least one embodiment of this invention, it is to be appreciated that various alterations, modifications, and improvements will readily occur to those skilled in the art. For example, the helmet mounting system described herein may be adapted for use in other applications such as mounting to body armor or a backpack. Such alterations, modifications, and improvements are intended to be part of this disclosure, and are intended to be within the spirit and scope of the invention. Accordingly, the foregoing description and drawings are by way of example only.

What is claimed is:

1. A helmet system comprising:

a helmet having a rim with a downwardly-facing rim portion;

a carrier attachable to the helmet only above the downwardly-facing rim portion, the carrier having a front and a back, wherein the back of the carrier faces the helmet when the carrier is attached to the helmet;

a first accessory mount that is removably attachable to the carrier, and with the first accessory mount attached to the carrier, an entire perimeter of the accessory mount is fully surrounded by the carrier and the first accessory mount is removably attachable to a base plate of an accessory while the carrier is attached to the helmet;

wherein the carrier is configured to receive the first accessory mount at the front of the carrier to attach the first accessory mount to the carrier, the first accessory mount being attachable to and removable from the carrier without removal of the carrier from the helmet; and wherein the carrier is compatible with receiving and retaining a second accessory mount, the first accessory mount and the second accessory mount being different types of accessory mounts.

2. The helmet system of claim 1, wherein the first accessory mount comprises a powered accessory mount and the second accessory mount comprises a non-powered accessory mount.

3. The helmet system of claim 2, wherein the powered accessory mount includes electrical contacts configured to power a device that is mounted to the powered accessory mount.

4. The helmet system of claim 1, wherein the carrier includes a central portion and at least one peripheral portion.

5. The helmet system of claim 4, wherein the central portion supports the first accessory mount and the at least one peripheral portion attaches the carrier to the helmet.

6. The helmet system of claim 4, wherein the at least one peripheral portion comprises an arc-shaped arm that conforms to the helmet.

7. The helmet system of claim 4, wherein the central portion comprises a frame that fully surrounds the entire perimeter of the first accessory mount.

8. The helmet system of claim 4, wherein the central portion and the at least one peripheral portion are integrally formed.

9. The helmet system of claim 4, wherein the at least one peripheral portion is configured to be attached to an accessory.

10. The helmet system of claim 1, wherein the downwardly-facing rim portion is configured and arranged to form a seal against an accessory.

11. The helmet system of claim 10, wherein the accessory comprises a face shield, a visor, or goggles.

12. The helmet system of claim 1, further comprising a shim that is configured to attach to the first accessory mount and secure the first accessory mount to the carrier.

13. The helmet system of claim 12, wherein the carrier includes tabs, and the shim is slidable between the first accessory mount and the tabs.

14. The helmet system of claim 1, further comprising the second accessory mount.

15. The helmet system of claim 1, wherein the carrier includes a frame configured to receive the first accessory mount to attach the first accessory mount to the carrier.

16. The helmet system of claim 15, wherein, with the first accessory mount removed from the carrier, the frame is configured to receive the second accessory mount to attach the second accessory mount to the carrier.

17. The helmet system of claim 1, wherein the carrier is configured to receive the second accessory mount at the front of the carrier to attach the second accessory mount to the carrier, the second accessory mount being attachable to and removable from the carrier without removal of the carrier from the helmet.

18. The helmet system of claim 17, further comprising the second accessory mount.

* * * * *